US008601829B2

(12) United States Patent
Heger et al.

(10) Patent No.: US 8,601,829 B2
(45) Date of Patent: Dec. 10, 2013

(54) ICE-MAKING MACHINE

(75) Inventors: Bernd Heger, Haunsheim (DE); Tom StQuintin, London (GB); Craig Duncan Webster, Cambridgeshire (GB); Nathan Wrench, Cambridge (GB)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1247 days.

(21) Appl. No.: 11/795,592

(22) PCT Filed: Dec. 1, 2005

(86) PCT No.: PCT/EP2005/056375

§ 371 (c)(1),
(2), (4) Date: Apr. 7, 2008

(87) PCT Pub. No.: WO2006/076981

PCT Pub. Date: Jul. 27, 2006

(65) Prior Publication Data

US 2009/0100856 A1 Apr. 23, 2009

(30) Foreign Application Priority Data

Jan. 24, 2005 (DE) ..... 10 2005 003 242

(51) Int. Cl.
*F25C 1/04* (2006.01)

(52) U.S. Cl.
USPC ..... 62/340

(58) Field of Classification Search
USPC ..... 62/351
See application file for complete search history.

(56) References Cited

U.S. PATENT DOCUMENTS

| | | | |
|---|---|---|---|
| 2,493,900 | A | 1/1950 | Schaberg et al. |
| 2,941,379 | A | 6/1960 | Nelson |
| 2,968,168 | A | 1/1961 | Lippincot |
| 3,071,933 | A | 1/1963 | Shoemaker |
| 3,180,103 | A | 4/1965 | Frohbieter |
| 3,182,468 | A | 5/1965 | Archer |
| 3,200,612 | A | 8/1965 | Frohbieter |
| 3,254,505 | A | 6/1966 | DeTurk |
| 3,362,181 | A | 1/1968 | Linstromb |
| 3,383,876 | A | 5/1968 | Frohbieter |
| 3,618,335 | A | 11/1971 | Toma |
| 3,952,539 | A | 4/1976 | Hanson et al. |
| 4,142,378 | A | 3/1979 | Bright et al. |
| 4,306,423 | A | 12/1981 | Webb et al. |

(Continued)

FOREIGN PATENT DOCUMENTS

| | | |
|---|---|---|
| CN | 1540268 | 10/2004 |
| DE | 26 48 177 | 4/1978 |

(Continued)

OTHER PUBLICATIONS

International Search Report PCT/EP2005/056375.

*Primary Examiner* — Cheryl J Tyler
*Assistant Examiner* — David Teitelbaum
(74) *Attorney, Agent, or Firm* — James E. Howard; Andre Pallapies

(57) ABSTRACT

In the case of an ice maker comprising a frame (15) and a tray (1), which is pivotable in the frame (15) about an axis and in which at least one compartment (4) is formed, a flexible line (12) connecting the tray (1) with the frame (15) extends in a curve about the pivot axis of the tray (1).

22 Claims, 4 Drawing Sheets

(56) References Cited

U.S. PATENT DOCUMENTS

| | | | | |
|---|---|---|---|---|
| 4,628,698 | A | 12/1986 | Needham et al. | |
| 4,852,359 | A | 8/1989 | Manzzotti | |
| RE34,174 | E * | 2/1993 | Brown et al. | 62/135 |
| 5,582,754 | A | 12/1996 | Smith et al. | |
| 5,992,167 | A | 11/1999 | Hill et al. | |
| 6,067,806 | A | 5/2000 | Park | |
| 6,112,540 | A * | 9/2000 | Serrels et al. | 62/351 |
| 6,314,745 | B1 | 11/2001 | Janke et al. | |
| 6,414,301 | B1 | 7/2002 | Borg, Jr. et al. | |
| 6,571,567 | B2 | 6/2003 | An et al. | |
| 6,658,869 | B1 | 12/2003 | Thornbrou | |
| 7,032,391 | B2 * | 4/2006 | Tremblay et al. | 62/68 |
| 2004/0177638 | A1 | 9/2004 | Onishi et al. | |
| 2004/0237564 | A1 | 12/2004 | Zevlakis | |

FOREIGN PATENT DOCUMENTS

| | | |
|---|---|---|
| JP | 5-280848 | 10/1993 |
| JP | 6-273014 | 9/1994 |
| JP | 7-19685 | 1/1995 |

* cited by examiner

ICE-MAKING MACHINE

The present invention relates to an automatic ice maker comprising a frame and a tray, which is pivotable in the frame about an axis and in which is formed at least one compartment able to be filled with water in order to produce a piece of ice in a shape predetermined by the compartment.

An ice maker of this kind is known from, for example U.S. Pat. No. 6,571,567 B2.

In this conventional ice maker a motor subassembly is coupled to a pivot axis of the tray in order to pivot the tray from an upright setting in which water can freeze in the compartments of the tray to an emptying setting in which the openings of the compartments face downwardly so that the pieces of ice could drop out. However, in this connection it is problematic that the finished pieces of ice usually adhere quite firmly to the walls of their compartment so that their weight alone is nowhere near sufficient to allow them to drop out of the compartments. For the proposed release by twisting the tray, a powerful and correspondingly large and expensive motor is required.

It is known from U.S. Pat. No. 3,180,103 to release finished pieces of ice from the compartments of a tray in that the tray is electrically heated until the pieces of ice thaw at the surface and to then push them out of the compartments with the help of a motor-driven pusher. Such an ice maker needs a large amount of space because in order to collect the finished pieces of ice either a collecting container, into which the finished pieces of ice are pushed, has to be placed near the tray or sufficient free space has to be present near the tray so that the pieces of ice can fall through the free space into a collecting container arranged thereunder.

If it is attempted to facilitate release of the pieces of ice, in the case of the ice maker of U.S. Pat. No. 6,571,567 B2, by heating then the problem arises that a heating means mounted in stationary location can heat the tray only less effectively; much heat is lost without use and leads merely to increased power consumption of a refrigerating appliance in which the ice maker is used. Mounting of the heating means at the tray obliges a supply line which extends between the tray and the frame and the operating safety of which in the moist, cold environment in which the ice maker is used is difficult to guarantee.

The object of the invention is to create an ice maker which conjoins a compact construction with a high degree of operational safety.

The object is fulfilled in that a flexible line connecting the tray with the frame extends in a curve about the pivot axis of the tray. A pivot movement of the tray leads, in the case of such a line, to at most a small loading in bending of the connecting points of the line to the frame or to the tray; essentially, merely the angle by which the line extends around the pivot axis changes slightly and the mean spacing of the line from the pivot axis decreases with increasing angle and increases with decreasing angle. A deformation, which is constrained by the pivot movement of the tray, of the line is distributed very uniformly over the length thereof and therefore leads to only a slight stressing of the material of the line.

Preferably the pivot axis is defined by a shaft around which the line extends.

In order to prevent an excessive curvature, which would load material, of the line in the case of a large pivot deflection a hollow winding core is preferably mounted to surround the shaft, around which the connecting line extends at a radial spacing. If in the case of a very strong pivot deflection the connecting line nests tightly against the winding core the then tautly tensioned connecting line prevents further pivotation.

The winding core is preferably arranged eccentrically with respect to the pivot axis in order to substantially avoid contact between the line and winding core, which could lead to rubbing wear.

A drum surrounding the connecting line substantially serves for protection of the connecting line against damage by foreign bodies as well as protection of a user against possible voltage-conducting contacting with the connecting line.

The drum is preferably mounted at the tray so that it pivots therewith. This makes it possible to fasten the winding core to the drum, preferably by detenting.

In order to mechanically relieve a connection of the connecting line, which extends continuously from the tray to the frame, at the tray, an intermediate piece of the connecting line extending continuously from the tray to the frame is preferably clamped between the tray and an arm radially protruding from the winding core.

Such an arm can also serve as a shield preventing contact between a movable part of the line and a possibly sharp-edged connecting point of the line with the tray.

As a further relief measure a hollow profile for fixing the intermediate piece in radial direction is provided at the arm.

The greater the freedom of pivot movement of the tray the greater should also be the angle at which the line extends around the axis. This angle preferably amounts to at least half a turn.

The connecting line is usually an electrical line; however, the invention is also usable in the same way for other kinds of lines such as, for example, a water line for filling the compartment with fresh water.

The electric line can, as already explained above, serve as a supply line for the electric heating device mounted at the tray; however, it can also serve as a single line for derivation of a temperature signal from a sensor or the like arranged at the tray.

The tray is preferably pivotable from the upright setting, in which the upper edges of the partition walls between the compartments of the tray extend horizontally, not only into the already mentioned emptying setting, but also into a tilted setting in which the compartments (4) communicate over the upper edges of the partition walls (3).

The compartments of the ice maker tray are preferably arranged in at least one row and a wall extending above the upper edge of intermediate spaces separating the compartments of the row from one another is formed at a longitudinal side of each row of compartments and at least a part of the transverse sides thereof. This construction of the ice maker tray makes it possible for water filled into the compartments in the tilted setting to flood over the partition walls to a region adjoining the protruding wall so that exactly the same water state can be achieved in all compartments. When this tray is, for freezing, pivoted into the upright setting in which the partition walls extend substantially horizontally and are no longer flooded over, pieces of ice cleanly separated from one another and with exactly the same size can be produced.

The tray is coupled to a motor for driving the pivot motion preferably by way of an eccentric mechanism. This converts a rotational movement of the motor in the same sense into an oscillating pivot motion of the tray of an amplitude predetermined by the construction of the eccentric mechanism. A directional control of the motor is thereby redundant and over-stretching or excess compression of the line can thereby be reliably excluded.

The eccentric mechanism preferably comprises a linearly displaceable oscillatory body carrying a rack meshing with a gearwheel connected with the tray. Any desired pivot stroke of the tray can be easily constructed by such an arrangement.

An eccentric element is preferably in engagement with a rail which extends at the oscillatory body transversely to the direction of movement thereof in order to convert the circulatory motion of the eccentric element into a reciprocating motion of the oscillatory body.

In order to facilitate removal of the finished pieces of ice from the mould the compartments preferably have the shape of a segment of a body of rotation. A piece of ice can be removed particularly simply from these compartments in that it slides in circumferential direction of the body of rotation without, as in the case of a conventional block-shaped piece of ice under consideration from, for example, U.S. Pat. No. 6,571,567 B2, forming, during removal from the mould, between the base of the compartment and the ice body a cavity which prevents removal from the mould as long as there is no equalisation of an underpressure prevailing in the cavity.

Further features and advantages of the invention are evident from the following description of examples of embodiment with reference to the accompanying figures, in which.

Figure 1:
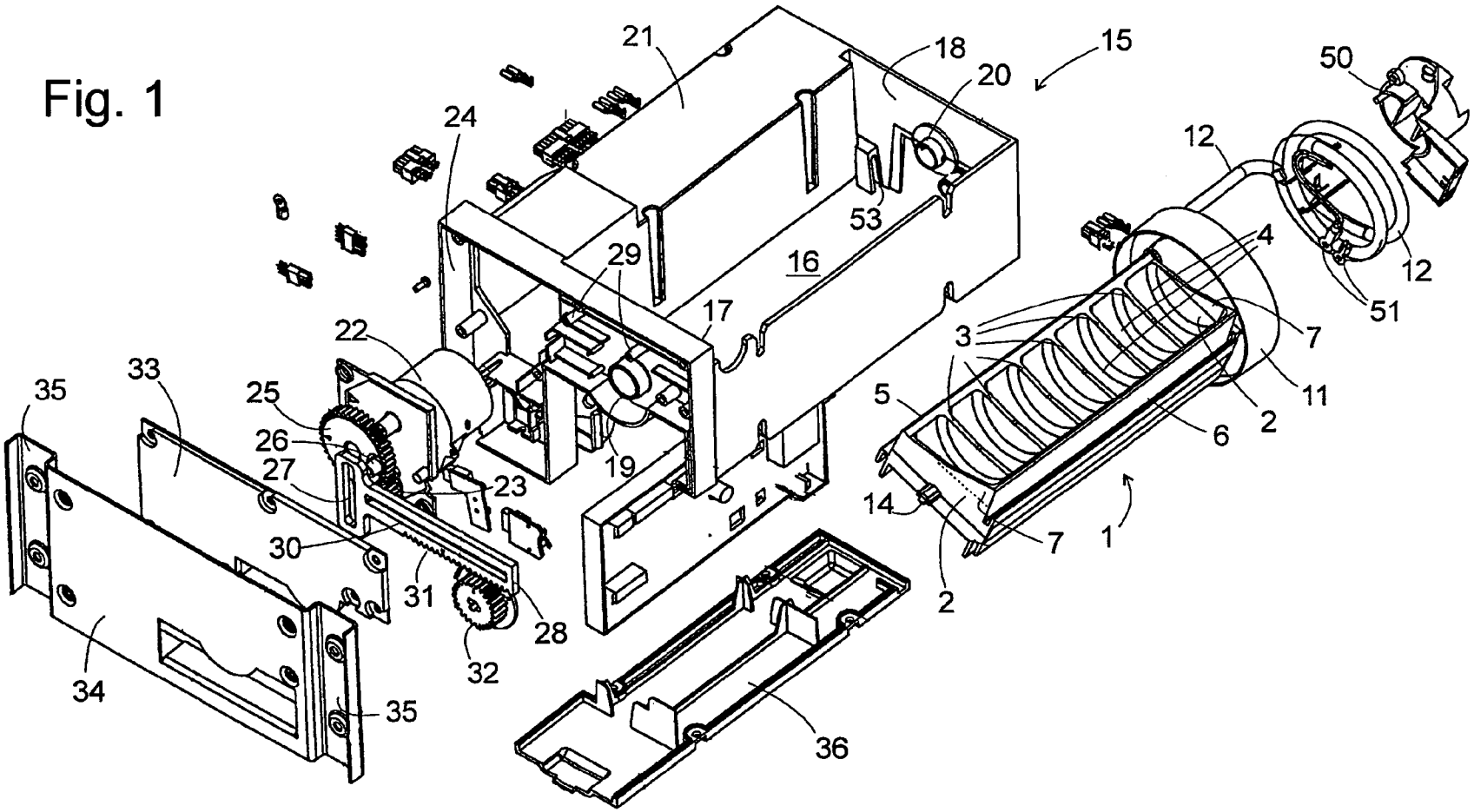
FIG. 1 shows an exploded illustration of an automatic ice maker according to a preferred embodiment of the invention.

FIG. 1 shows an automatic ice cube maker according to the present invention in an exploded perspective view. It comprises a tray 1 in the form of a channel, which is closed at its ends by respective transverse walls 2 and is divided by partition walls 3, which are arranged at uniform spacings, into a plurality of identically shaped compartments 4, here seven units, with a semi-cylindrical base. Whereas the partition walls 3 at the longitudinal wall 5 remote from the viewer adjoin flushly, the longitudinal wall 6 facing the viewer is prolonged above the upper edges of the partition walls 3. Whilst the partition walls 3 are exactly semicircular, the transverse walls 2 each have a sector 7, which goes out above the semicircular shape, in correspondence with the protrusion of the front longitudinal wall 6.

The tray 1 is shown in a tilted setting in which the upper edges of the segments 7 extend substantially horizontally, whilst those of the partition walls 3 are inclined towards the longitudinal wall 6.

The tray 1 can be a plastics material moulded part, but preferably, due to the good capability of thermal conductance, it is constructed as a cast part of aluminium.

Figure 9:
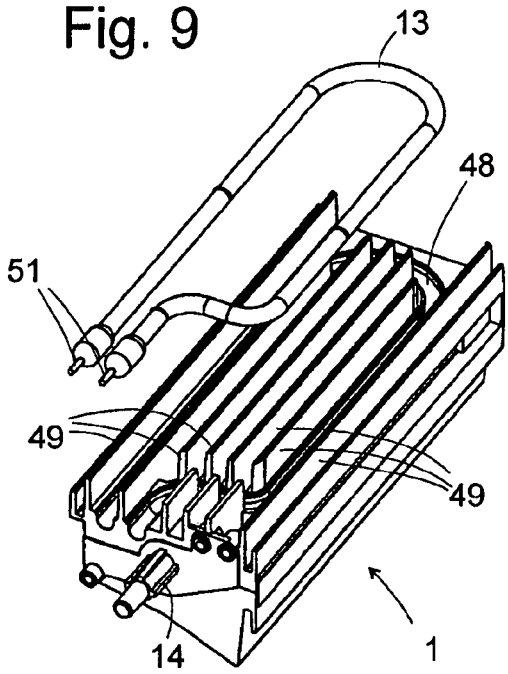
FIG. 9 shows a perspective exploded view from below of the ice-maker tray.

A cable drum 11 is mounted at one of the transverse walls 2 of the tray 1; it serves for protected accommodation of a coiled power supply cable 12 serving for supply of current to a heating device 13, which is not visible in the figure, accommodated at the underside of the tray 1 (see FIG. 9). The tray 1 lies completely within a imaginary hollow cylinder defined by the circumferential surface of the cable drum 11, which at the same time represents the smallest possible cylinder into which the tray 1 fits. An axial spigot 14, which protrudes from the transverse wall 2 facing the viewer, extends on the longitudinal centre axis of the cable drum 11. A corresponding axial spigot extending from the second transverse wall through the cable drum 11 is not visible in the figure. A winding core 50 made of plastics material is provided in order to be mounted, curled around by the supply cable 12, in the cable drum 11.

A frame moulded from plastics material is denoted by 15. It has an upwardly and downwardly open cavity 16 which is provided for mounting of the tray 1 therein. Bearing bushes 19, 20 for the pivotable mounting of the tray 1 are formed at the end walls 17, 18 of the cavity 16. A longitudinal wall of the cavity 16 is formed by a box 21, which is provided for reception of a drive motor 22 as well as various electronic components for control of operation of the ice maker. Mounted on the shaft of the drive motor 22 is a pinion 23 which can be seen better in each of FIGS. 3, 4, 6 and 8 than in FIG. 2. When the ice maker is in fully mounted state the pinion 23 finds space in a cavity 24 of the end wall 17. It forms there, together with a gearwheel 25, a speed step-down transmission.

The gearwheel 25 carries a pin 26 which protrudes in axial direction and which is provided for engaging in a vertical slot 27 of an oscillatory body 28. The oscillatory body 28 is guided to be horizontally displaceable with the help of pins 29 which protrude from the end wall 17 into the cavity 24 and which engage in a horizontal slot 30 of the oscillatory body. A toothing 31 formed at a lower edge of the oscillatory body 28 meshes with a gearwheel 32, which is provided for the purpose of being plugged onto the axial spigot 14 of the tray 1 to be secure against rotation relative thereto.

A cover plate 33 screw-connected to the open side of the end wall 17 closes the cavity 24. A fastening flange 34 with straps 35 protruding laterally beyond the end wall 17 serves for mounting the ice maker in a refrigerating appliance. A base plate 36 closes the box 21 at the bottom.

Figure 2:
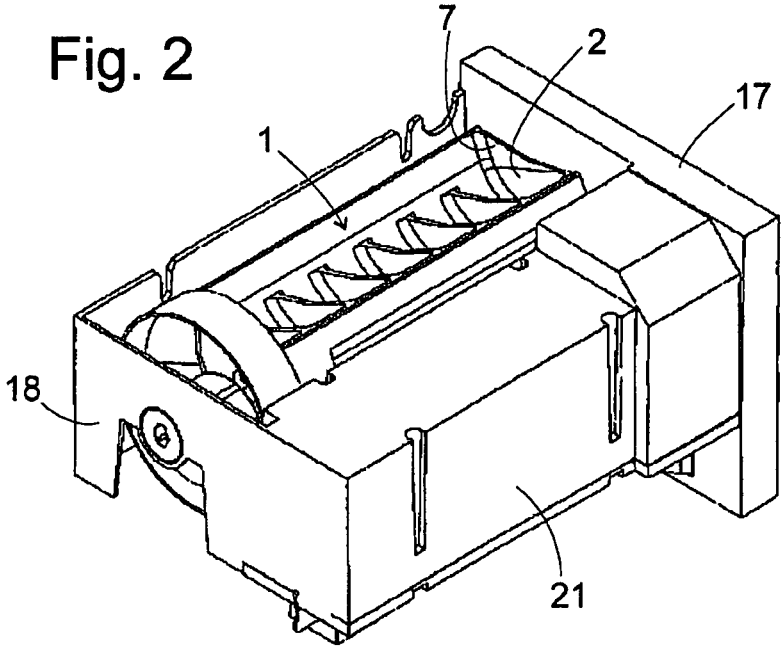
FIG. 2 shows a perspective view of the ice maker according to FIG. 1 in assembled state with ice-maker tray in tilted setting.

FIG. 2 shows, as seen from the side of the end wall 18 and the box 21, the ice maker with the tray 1 in tilted setting in perspective view. The upper edges of the sectors 7 at the transverse walls 2 of the tray 1 extend horizontally.

Figure 3:
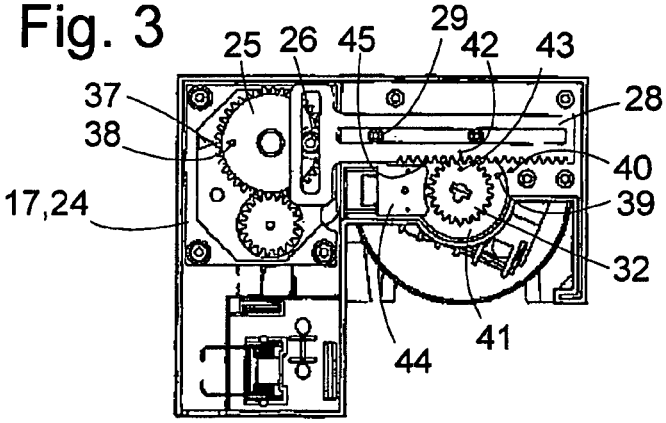
FIG. 3 shows a front view of the ice maker of FIG. 1 or 2 in the direction of the pivot axis.

FIG. 3 shows a front view of the ice maker from the side of the end wall 17, wherein cover plate 33 and fastening flange 34 have been omitted in order to give free view into the cavity 24 of the end wall 17. The configuration shown here is that in which the ice maker is mounted together. Various markings indicate a correct positioning of individual parts relative to one another. A first pair of markings 37, 38 is disposed at the end wall 17 itself, or at the gearwheel 25 carrying the pin 26. When these markings 37, 38 are, as shown in the figure, aligned exactly with one another the pin 26 is disposed in a 3 o'clock setting, i.e. on the point, which lies furthest to the right in the perspective view of the figure, of its path which it can reach. The oscillatory body 28 plugged onto the pin 26 as well as the stationary pin 29 is disposed at the righthand reversal point of its path.

Markings 39, 40, which are aligned with one another, at a flange 41 of the gearwheel 32 protruding beyond the tooth rim and at the end wall 17 indicate a correct orientation of the gearwheel 32 and as a consequence thereof also of the tray 1 engaging by its axial spigot 14 in a cut-out, which is T-shaped in cross-section, of the gearwheel 32. A pair, which is redundant per se, of markings 42, 43 at the toothing 31 of the pivot body 28 and at the gearwheel 32 shows the correct positioning of gearwheel 32 and oscillatory body 31 with respect to one another.

Figure 4:
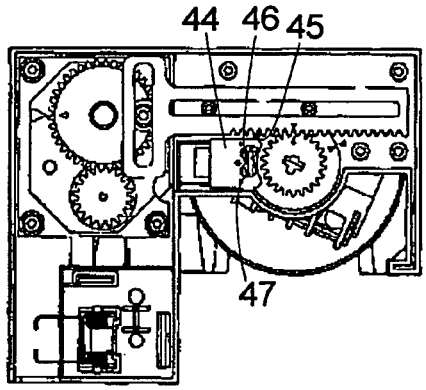
FIG. 4 shows the view of FIG. 3 with partly cut-away sensor housing.
Figure 7:
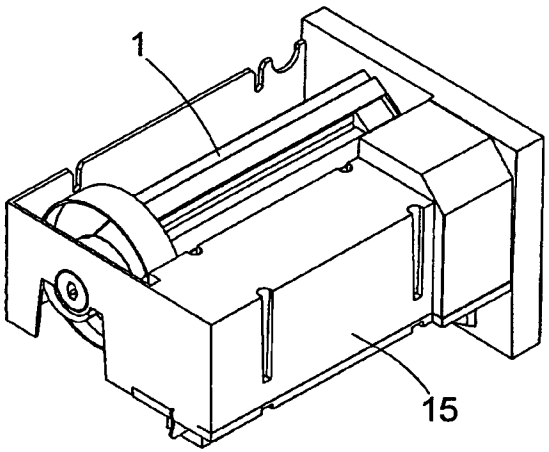
FIG. 7 shows a perspective view analogous to FIGS. 2 and 5 with the ice-maker tray in emptying setting.

A sensor 44 for detecting the rotational setting of the gearwheel 32 is mounted near this. It co-operates with a rib 45, which protrudes in axial direction from the edge of the flange 41 on a part of the circumference thereof so that it can enter into a slot at the rear side of the sensor housing. In the tilted setting of FIG. 3 the rib is covered for the greatest part by the sensor 44 and the oscillatory body 28. FIG. 4 differs from FIG. 3 in that the housing of the sensor 44 is shown in part cut away so that two light barriers 46, 47 bridging over the slot can be recognised in its interior. The rib 45 is disposed closely above the two light barriers 46, 47 so that a control electronic system, which is not illustrated, can recognise, on the basis of the fact that the two light barriers are open, that the tray 1 is disposed in the tilted setting and can stop the drive motor 22 in order to be able to keep the tray 1 in the tilted setting and fill it.

Figure 5:
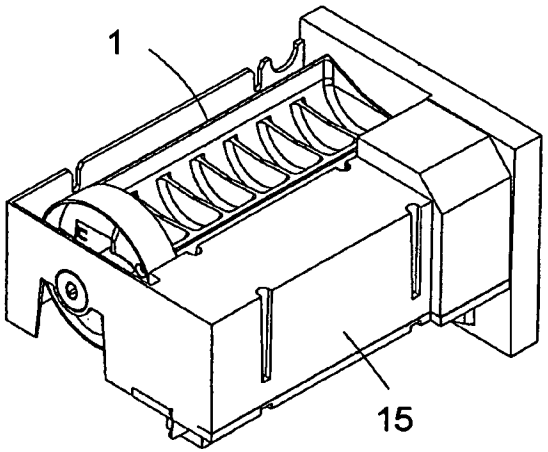
FIG. 5 shows a view, which is analogous to FIG. 2, with ice-maker tray in upright setting.
Figure 6:
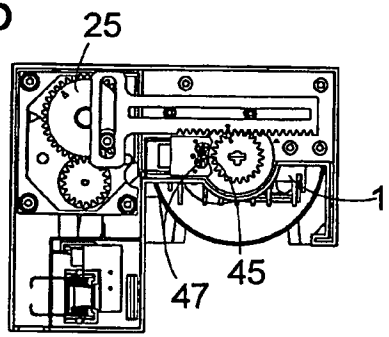
FIG. 6 shows a view, which is analogous to FIG. 4, with the ice-maker tray in upright setting.

After a predetermined water quantity has been admetered to the tray 1 under the control of the control circuit the drive motor 22 is set in operation by the control unit in order to bring the tray 1 into the upright setting in which the water quantities in the compartments 4 of the tray 1 are cleanly separated from one another. This setting is shown in FIG. 5 in a perspective view corresponding with FIG. 2 and in FIG. 6 in a front view corresponding with FIG. 4. The gearwheel 25 is further rotated in clockwise sense relative to the setting of FIG. 4, although the same setting of the tray 1 can also be reached by rotation of the gearwheel 25 in counter-clockwise sense. Attainment of the upright setting is recognised when the rib 45 begins to block the lower light barrier 47.

The tray 1 remains in the upright setting for such a length of time until the water in the compartments 4 is frozen. The dwell time in the upright setting can be fixedly predetermined; alternatively, the control circuit can also be connected with a temperature sensor in order to be able to establish, on the basis of a measured temperature in the environment of the tray 1 and a characteristic curve stored in the control circuit, a respective time period sufficient in the case of the measured temperature for freezing the water.

Figure 8:
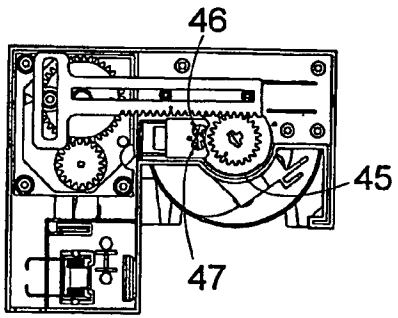
FIG. 8 shows a view analogous to FIG. 4 or 6.

After expiry of this time period the drive motor 22 is set back into operation in order to rotate the gearwheel 25 into the setting shown in FIG. 8, with the pin 26 in the 9 o'clock position. The control circuit recognises that this position is reached when the two light barriers 46, 47 are again open. The rib 45 is now able to be clearly seen in the figure for a major part of its length.

In this setting the compartments 4 of the tray 1 are downwardly open so that the pieces of ice contained therein can drop out. The already mentioned electric heating device 13 is provided in order to facilitate release of the pieces of ice. As can be recognised in FIG. 9, this heating device 13 is an electric heating rod, which is bent into a loop and which extends in close contact with the tray 1 between heat exchange ribs 49 protruding at the underside thereof and is in part received in a groove 48 formed at the underside of the tray 1.

Through brief heating of the tray 1 with the help of the heating device 13 the pieces of ice in the compartments 4 are thawed at the surface. The water layer thus produced between the tray 1 and the pieces of ice acts as a slide film on which the pieces of ice are movable with very low friction. By virtue of the cross-sectional shape of the compartments 4 in the form of a segment of a cylinder the pieces of ice easily slide out of the compartments 4 and drop into a collecting container (not illustrated) arranged below the ice maker.

After emptying of the compartments 4, the drive motor is set back into operation and the gearwheel 25 further rotated in clockwise sense until it again reaches the setting shown in FIGS. 2 to 4 and a new operating cycle of the ice maker begins.

Figure 10:
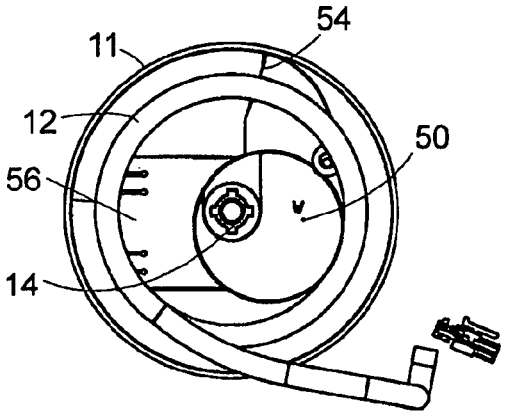
FIG. 10 shows a front view of the cable drum.
Figure 12:
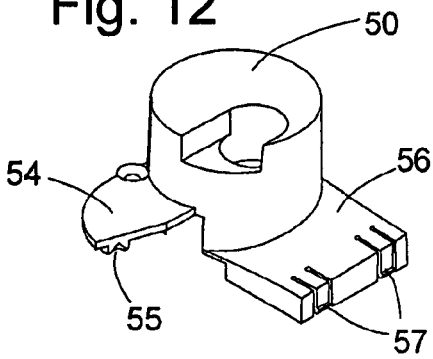
FIG. 12 shows a perspective view of a winding core for the supply cable.

The pivotation to and fro of the tray is accompanied by the fact that the supply cable 12 shown in FIG. 1 is continuously deformed, the cable being fastened by one end at the level of the transverse wall 2 by two soldering eyes 51 to contact pins 52 of the heating device 13 and the other end of the cable being guided through a notch 53 in the wall of the box 21 receiving the electronic control system. The hollow-cylindrical winding core 50 shown in perspective view in FIG. 12 is provided for protection of the cable 12 against rubbing wear. Approximately one-and-a-half coils of the supply cable 12 are, as can be seen in FIG. 10, looped in the cable drum 11 loosely around the winding core 50.

Figure 11:
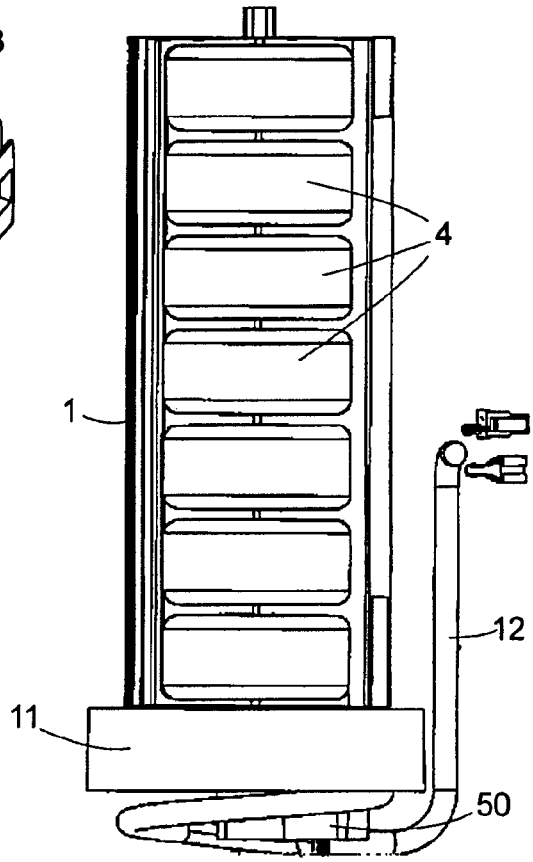
FIG. 11 shows a plan view of the tray with cable drum and supply cable.

The winding core 50 has an eccentric cylindrical bore which is plugged in rotationally fast manner on to an axial spigot 14 of the tray. The centre point of the winding core 50 is displaced from the pivot axis towards the end, which is clamped in the notch 53, of the supply cable. When the tray is pivoted in clockwise sense in the perspective view of FIG. 11, the coils of the cable 12 narrow and a tension force produced by the resilience of the cable 12 and acting in the direction of the end held in the notch 53 draws the cable coils downwardly to the right in FIG. 10 towards the notch 53 (not shown here) so that the coils, although they become narrower, are spaced from the winding core 50. In the case of rotation in counter-clockwise sense the resulting widening of the coils normally prevents contact between cable 12 and winding core 50.

The deformable coils end at an arm 54 which radially protrudes from the winding core 50 and which presses the cable 12, which dips away under it, against the transverse wall 2 of the tray disposed therebehind. As can be recognised in FIG. 12, a notch 55 which receives the cable 12 and fixes it in radial direction is formed at the underside of the arm 54.

The contact pins of the heating device 13 are concealed under a second arm 56 radially protruding from the winding core 50, so that the movable coils of the supply cable 12 cannot chafe thereagainst in operation. Resilient detent fingers 57 of the outer wall of the arm 56 serve for anchoring in a cut-out, which is of complementary shape, in the interior of the cable drum 11.

The invention claimed is:

1. An ice maker comprising:

a frame;

a tray which is pivotable in the frame about an axis and in which at least one compartment is formed; and a flexible connecting line connecting the tray with the frame extending in a curve about the pivot axis of the tray, wherein the curve of the connecting line is received in a drum, and wherein the drum is mounted at the tray.

2. The ice maker according to claim 1, wherein the axis is defined by a shaft section, and wherein the connecting line extends at a radial spacing around the shaft section.

3. The ice maker according to claim 2, wherein the connecting line extends at a radial spacing around a hollow winding core surrounding the shaft section.

4. The ice maker according to claim 3, wherein the winding core is arranged eccentrically.

5. The ice maker according to claim 3, wherein the winding core is detented to the drum.

6. The ice maker according to claim 3, wherein an intermediate piece of the connecting line extending continuously from the tray to the frame is clamped between the tray and an arm radially protruding from the winding core.

7. The ice maker according to claim 6, wherein the arm has a hollow profile for fixing the intermediate piece in radial direction.

8. The ice maker according to claim 3, wherein an arm radially protruding from the winding core extends between a connecting point of the line at the tray and a movable part of the line.

9. The ice maker according to claim 1, wherein the curve goes around at least half the pivot axis.

10. The ice maker according to claim 1, wherein the connecting line includes an electrical line.

11. The ice maker according to claim 10, further comprising a temperature sensor connected with the connecting line.

12. The ice maker according to claim 10, further comprising an electric heating device connected with the connecting line.

13. The ice maker according to claim 1, wherein the tray is pivotable between an upright setting in which the upper edges of the partition walls extend horizontally and an emptying setting in which the openings of the compartments face downwardly.

14. The ice maker according to claim 1, wherein the tray is pivotable between an upright setting in which the upper edges of the partition walls extend horizontally and a tilted setting in which the compartments communicate via the upper edges of the partition walls.

15. The ice maker according to claim 1, wherein several compartments are arranged in a number of rows parallel to the pivot axis and that a wall extending above upper edges of partition walls separating the compartments of a row from one another is formed at a longitudinal side of each row of compartments and at least a part of the transverse sides thereof.

16. The ice maker according to claim 1, wherein the tray is coupled to a motor by way of an eccentric mechanism.

17. The ice maker according to claim 1, wherein the compartments each have the form of a segment of a body of rotation.

18. An ice maker comprising:

a frame;

a tray which is pivotable in the frame about an axis and in which at least one compartment is formed;

a flexible connecting line connecting the tray with the frame extending in a curve about the pivot axis of the tray;

a cable drum connected to the tray and housing the flexible connecting line; and a winding core connected to the tray, wherein the flexible connecting line is looped in the cable drum around the winding core, wherein the winding core includes an eccentric cylindrical bore receiving an axial spigot of the tray.

19. An ice maker comprising:

a frame;

a tray which is provided in the frame about an axis and in which at least one compartement is formed;

a flexible connecting line connecting the tray with the frame extending in a curve about the pivot axis of the tray;

a cable drum connected to the tray and housing the flexible connecting line; and a winding core connected to the tray, wherein the flexible connecting line is looped in the cable drum around the winding core, wherein a center point of the winding core is displaced from the pivot axis of the tray.

20. An ice maker comprising:

a frame;

a tray which is pivotable in the frame about an axis and in which at least one compartment is formed;

a flexible connecting line connecting the tray with the frame extending in a curve about the pivot axis of the tray; and an intermediate piece of the connecting line extending continuously from the tray to the frame clamped between the tray and an arm radially protruding from the winding core, wherein the axis is defined by a shaft section, wherein the connecting line extends at a radial spacing around the shaft section, and wherein the connecting line extends at a radial spacing around a hollow winding core surrounding the shaft section.

21. The ice maker according to claim 20, wherein the arm has a hollow profile for fixing the intermediate piece in radial direction.

22. An ice maker comprising:

a frame;

a tray which is pivotable in the frame about an axis and in which at least one compartment is formed;

a flexible connecting line connecting the tray with the frame extending in a curve about the pivot axis of the tray, wherein the axis is defined by a shaft section, wherein the connecting line extends at a radial spacing around the shaft section, and wherein the connecting line extends at a radial spacing around a hollow winding core surrounding the shaft section; and an arm radially protruding from the winding core that extends between a connecting point of the line at the tray and a movable part of the line.

* * * * *

UNITED STATES PATENT AND TRADEMARK OFFICE

CERTIFICATE OF CORRECTION

PATENT NO. : 8,601,829 B2
APPLICATION NO. : 11/795592
DATED : December 10, 2013
INVENTOR(S) : Heger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 721 days.

Signed and Sealed this
Twenty-second Day of September, 2015

Michelle K. Lee

Michelle K. Lee
*Director of the United States Patent and Trademark Office*